US006106108A

United States Patent [19]

Cluet

[11] Patent Number: 6,106,108

[45] Date of Patent: Aug. 22, 2000

[54] ADAPTIVE IMAGE-BASED ALGORITHM FOR REFILL-WHILE-PRINTING TRIGGERING

[75] Inventor: Miquel Cluet, Barcelona, Spain

[73] Assignee: Hewlett-Packard Company, Palo Alto, Calif.

[21] Appl. No.: 09/183,129

[22] Filed: Oct. 30, 1998

[51] Int. Cl.[7] ..... B41J 2/145

[52] U.S. Cl. ..... 347/84; 347/19

[58] Field of Search ..... 347/7, 19, 84, 347/85, 183, 188; 358/298

[56] References Cited

U.S. PATENT DOCUMENTS

| | | | |
|---|---|---|---|
| 4,187,511 | 2/1980 | Robinson | 347/7 |
| 4,943,813 | 7/1990 | Palmer et al. | 347/41 |
| 5,655,174 | 8/1997 | Hirst | 347/19 |
| 5,712,667 | 1/1998 | Sato | 347/7 |
| 5,721,573 | 2/1998 | Benjamin | 347/19 |
| 5,802,420 | 9/1998 | Garr et al. | 347/7 |
| 5,914,731 | 6/1999 | Yano et al. | 347/9 |

*Primary Examiner*—N. Le
*Assistant Examiner*—Anh T. N. Vo

[57] ABSTRACT

A technique for triggering refill of a take-a-gulp ink delivery system during printing of a plot. The system includes the capability of tracking the ink volume remaining in one or more of the on-board ink reservoirs, and detecting when a reservoir needs refilling. If this occurs while plotting, the system can invoke a refill operation as if doing a normal pen servicing, which entails moving the carriage to the service/refill station, even though the plot is not completed, and performing a refill operation. To minimize artifacts of the plot due to the printing interruption, a location to interrupt the plot at which the ink density is low is selected based on the prior history of the plot.

21 Claims, 6 Drawing Sheets

ADAPTIVE IMAGE-BASED ALGORITHM FOR REFILL-WHILE-PRINTING TRIGGERING

CROSS-REFERENCE TO RELATED APPLICATIONS

This application is related to the following commonly assigned, co-pending applications, the entire contents of which are incorporated herein by this reference:

- U.S. application Ser. No. 09/183,348, filed Oct. 30, 1998, MID PLOT REFILL TECHNIQUE FOR LARGE SCALE PLOTTERS, by J. L. Garcia et al.
- U.S. application Ser. No. 08/805,860, filed Mar. 3, 1997, SPACE-EFFICIENT ENCLOSURE SHAPE FOR NESTING TOGETHER A PLURALITY OF REPLACEABLE INK SUPPLY BAGS, by Erich Coiner et al.
- U.S. application Ser. No. 08/810,840, filed Mar. 3, 1997, PRINTING SYSTEM WITH SINGLE ON/OFF CONTROL VALVE FOR PERIODIC INK REPLENISHMENT OF PRINTHEAD, by Max S. Gunther et al.
- U.S. application Ser. No. 08/805,861, filed Mar. 3, 1997, PRINTER APPARATUS FOR PERIODIC AUTOMATED CONNECTION OF INK SUPPLY VALVES WITH MULTIPLE PRINTHEADS, by Ignacio Olazabal et al.
- U.S. application Ser. No. 08/726,587, filed Oct. 7, 1996, INKJET CARTRIDGE FILL PORT ADAPTER, Robert J. Katon et al.
- U.S. application Ser. No. 09/032,225, filed Feb. 27, 1998, PERIODIC INK REPLENISHMENT STATION WITH REMOVABLE OFF-CARRIAGE INK SUPPLY CONTAINERS, Felix Ruiz et al.

TECHNICAL FIELD OF THE INVENTION

This invention relates to ink-jet printers, and more particularly to techniques for triggering refill of the on-carriage ink reservoirs of a printer during a plot while minimizing printing artifacts resulting from stopping in mid-plot for refilling.

BACKGROUND OF THE INVENTION

Swath printers/plotters are in widespread use today for printing many types of images. A printing system suitable for a printer is described in U.S. Pat. No. 5,745,137, which employs off-carriage ink reservoirs connected to on-carriage print cartridges through flexible tubing. The off-carriage reservoirs continuously replenish the supply of ink in the internal reservoirs of the on-carriage print cartridges (or "printheads" or "pens") , and maintain the back pressure in a range which results in high print quality. While this system has many advantages, there are some applications in which the relatively permanent connection of the off-carriage and on-carriage reservoirs via tubing is undesirable.

An ink delivery system (IDS) for printers has been developed, wherein the on-carriage reservoir of the printhead is only intermittently connected to the off-carriage reservoir to "take a gulp" and is then disconnected from the off-carriage reservoir. No tubing permanently connecting the on-carriage and off-carriage elements is needed. The above-referenced related applications describe certain features of this "take a gulp" ink delivery system.

The take-a-gulp system as well as other large scale plotters can be employed to print large color images, wherein significant volumes of the colored inks can be used from the on-carriage reservoirs. The system includes the capability of tracking the ink volume remaining in one or more of the on-board ink reservoirs, and detecting when a reservoir needs refilling. If this occurs while printing, and the system were to invoke a refill operation as if doing a normal pen servicing, the carriage would be moved to the service/refill station, even though the plot is not completed, and the refill operation performed. A problem is that this interruption in printing leaves the image drying for a relatively long period of time, perhaps several minutes, before printing is resumed to complete the plot. In some medias this action creates an artifact, a visible horizontal band all across the page, at the area at which printing was interrupted for the refill.

There has been no solution to this problem. In other platforms, printing was continued until the cartridge ran out of ink and then the machine cancelled the plot.

It would therefore represent an advance in the art to provide a technique for reducing artifacts resulting from mid-plot-refill.

SUMMARY OF THE INVENTION

A technique is described for adaptively triggering a refill operation in an on-carriage printhead in a printer system. The system has a movable carriage mounting the print cartridge, and an off-carriage ink supply available for intermittent connection to the internal reservoir of the printhead for the refill operation. The printer has the capability to keep track of the amount of ink spent from the printhead. The technique includes the following:

- commencing a printing operation for a plot;
- determining whether a refill operation needs to be performed prior to completion of the plot;
- determining a location in the plot of low ink density;
- interrupting the printing to perform a refill operation for the printhead reservoir at said low ink density location to reduce printing artifacts; and
- resuming the printing of the plot.

By stopping the plot at low ink density locations for the refill operation, artifacts resulting from plot interruption are reduced. In typical applications, the details of the plot are not known to the system, since an external writing system typically provided plot instructions and commands. The technique predicts the locations of low ink density based on the past ink density history observed during the current plot, and triggers the refill when the plot is predicted to be at an local ink density minimum.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
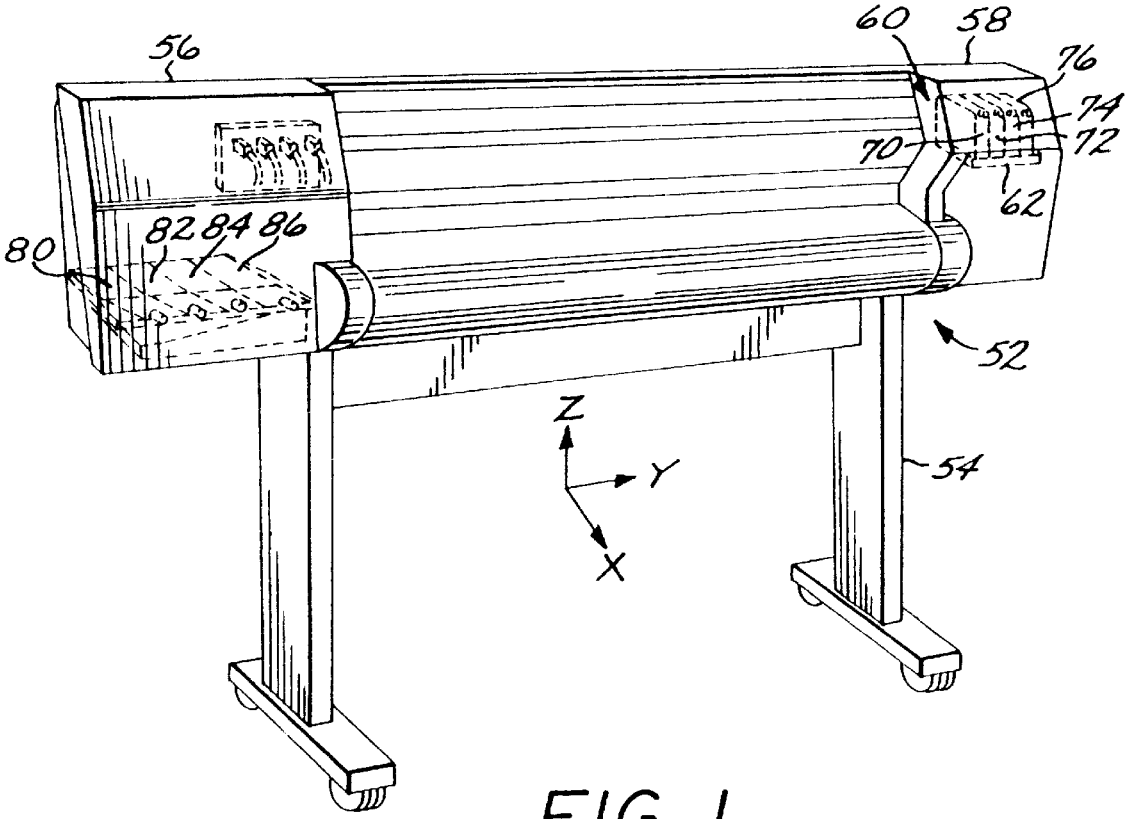
FIG. 1 is an isometric view of a large format printer system employing the invention.
Figure 2:
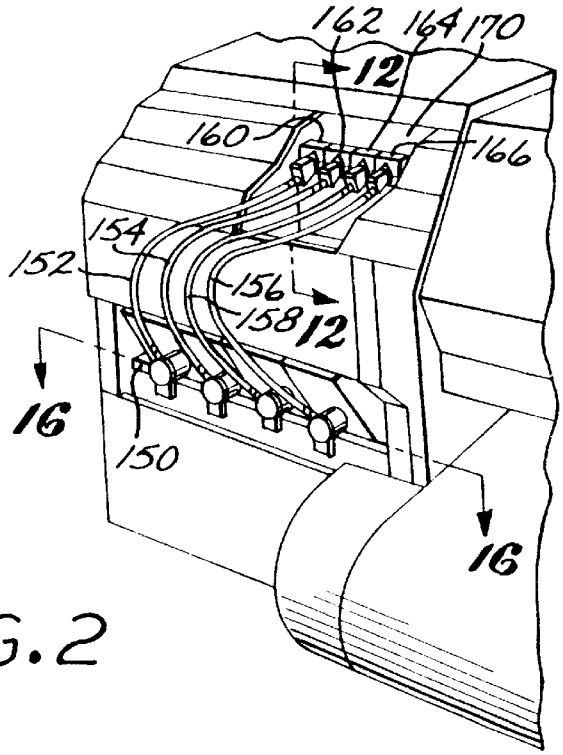
FIG. 2 is an enlarged view of a portion of the system of FIG. 1, showing the refill station.

An exemplary application for the invention is in a swath printer for large format printing (LFP) applications. FIG. 1 is a perspective view of an ink-jet large format printer 50. The printer 50 includes a housing 52 mounted on a stand 54 with left and right covers 56 and 58. A carriage assembly 60 is adapted for reciprocal motion along a carriage slide rod. A print medium such as paper is positioned along a media axis by a media axis drive mechanism. As is common in the art, the media drive axis is denoted as the 'x' axis, the carriage scan axis is denoted as the 'y' axis, and the 'z' axis is oriented vertically.

Figure 3:
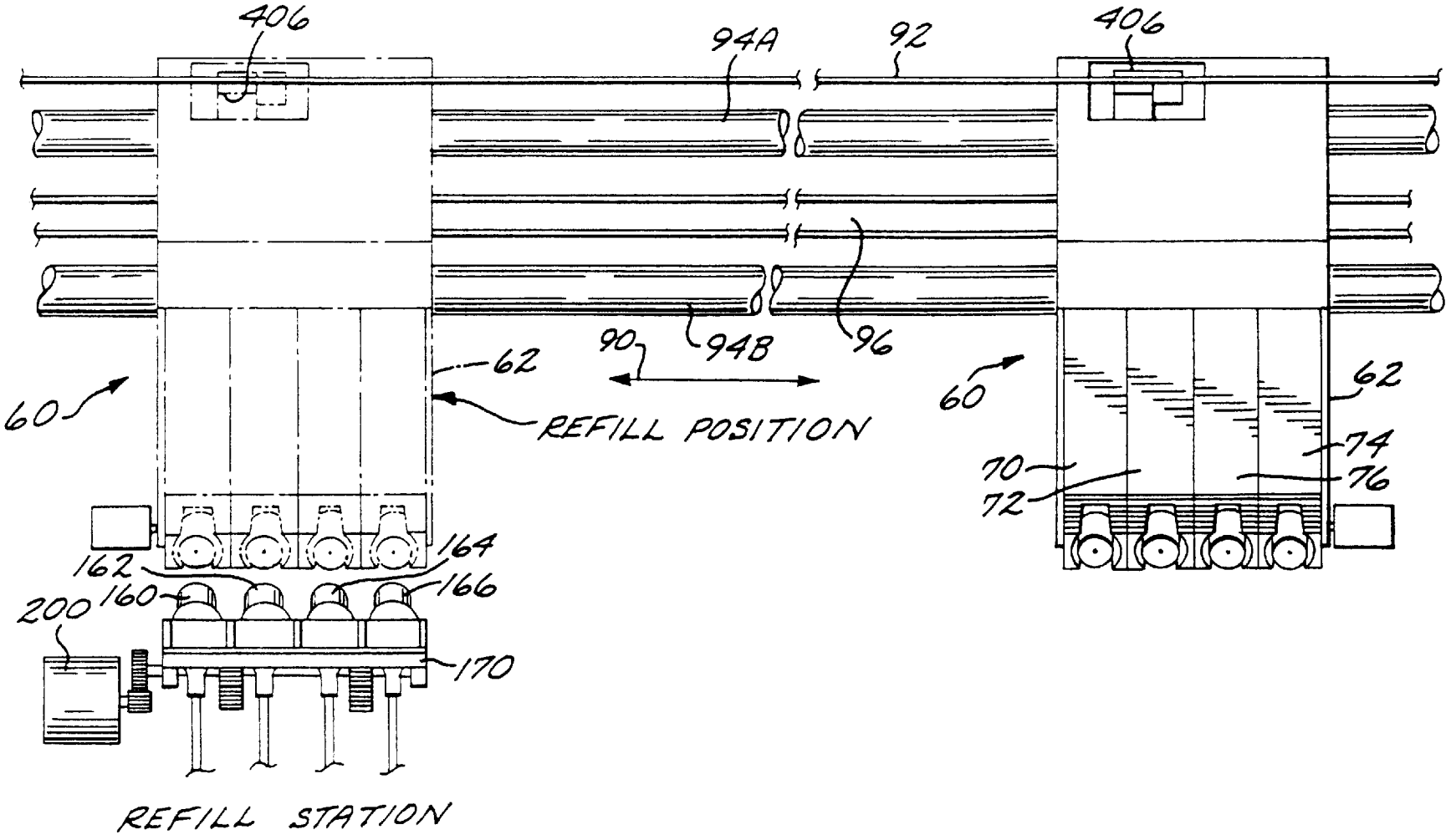
FIG. 3 is a top view showing the printer carriage and refill station.

FIG. 3 is a top view diagrammatic depiction of the carriage assembly 60, and the refill station. The carriage assembly 60 slides on slider rods 94A, 94B. The position of the carriage assembly 60 along a horizontal or carriage scan axis is determined by a carriage positioning mechanism with respect to an encoder strip 92. The carriage positioning mechanism includes a carriage position motor (FIG. 4) which drives a belt 96 attached to the carriage assembly. The position of the carriage assembly along the scan axis is determined precisely by the use of the encoder strip. An optical encoder 208 (FIG. 4) is disposed on the carriage assembly and provides carriage position signals which are utilized to achieve optimal image registration and precise carriage positioning.

The printer 50 has four ink-jet printheads or pens 70, 72, 74, and 76 that store ink of different colors, e.g., yellow, cyan, magenta and black ink, respectively, in internal spring-bag reservoirs. As the carriage assembly 60 translates relative to the medium along the y axis, selected nozzles in the ink-jet printheads are activated and ink is applied to the medium.

The carriage assembly 60 positions the printheads 70–76, and holds the circuitry required for interface to the heater circuits in the printheads. The carriage assembly includes a carriage 62 adapted for the reciprocal motion on the front and rear sliders 92A, 92B. The printheads are secured in a closely packed arrangement, and may each be selectively removed from the carriage for replacement with a fresh printhead. The carriage includes a pair of opposed side walls, and spaced short interior walls, which define printhead compartments. The carriage walls are fabricated of a rigid engineering plastic. The nozzle arrays of the printheads are exposed through openings in the printhead compartments facing the print medium.

As mentioned above, full color printing requires that the colors from the individual printheads be applied to the media. This causes depletion of ink from the internal printhead reservoirs. The printer 50 includes four take-a-gulp IDSs to meet the ink delivery demands of the printing system. Each IDS includes three components, an off-carriage ink reservoir, an on-carriage printhead, and a printhead cleaner. The ink reservoir includes a bag holding a quantity of ink, e.g. 370 ml, with a short tube and refill valve attached. Details of a ink reservoir bag structure suitable for the purpose are given in co-pending application Ser. No. 08/805,860, filed Mar. 3, 1997, SPACE-EFFICIENT ENCLOSURE SHAPE FOR NESTING TOGETHER A PLURALITY OF REPLACEABLE INK SUPPLY BAGS, by Erich Coiner et al. These reservoirs are fitted on the left-hand side of the printer (behind the door of the left housing 58) and the valves attach to a valve holder arm, also behind the left door, as described more fully in co-pending application Ser. No. 09/032,746, filed Feb. 2, 1997 entitled CARRIAGE STABILIZATION DURING PERIODIC VALVE ENGAGEMENT FOR PRINTHEAD REPLENISHMENT, the entire contents of which are incorporated herein by reference. The print-head in this exemplary embodiment includes a 300-nozzle, 600 dpi nozzle array, and an orifice through which it is refilled. The printhead cleaner (not shown) includes a spittoon for catching ink used when servicing and calibrating the printheads, a wiper used to wipe the face of the printhead, and a cap (used to protect the printhead when it is not in use). These three components together comprise the IDS for a given color and are replaced as a set by the user in this exemplary embodiment.

The proper location of each component is preferably identified by color. Matching the color on the replaced component with that on the frame that accepts that component will ensure the proper location of that component. All three components will be in the same order, with, in an exemplary embodiment, the yellow component to the far left, the cyan component in the center-left position, the magenta component in the center-right position and the black component in the far-right position.

The ink delivery systems are take-a-gulp ink refill systems. The system refills all four printheads 70–76 simultaneously when any one of the printhead internal reservoir's ink volume has dropped below a threshold value. A refill sequence can be initiated immediately after completion of the print that caused the printhead reservoir ink volume to drop below the threshold. Alternatively, in accordance with aspects of the invention, a mid-plot refill is initiated under certain circumstances as described below.

Figure 4:
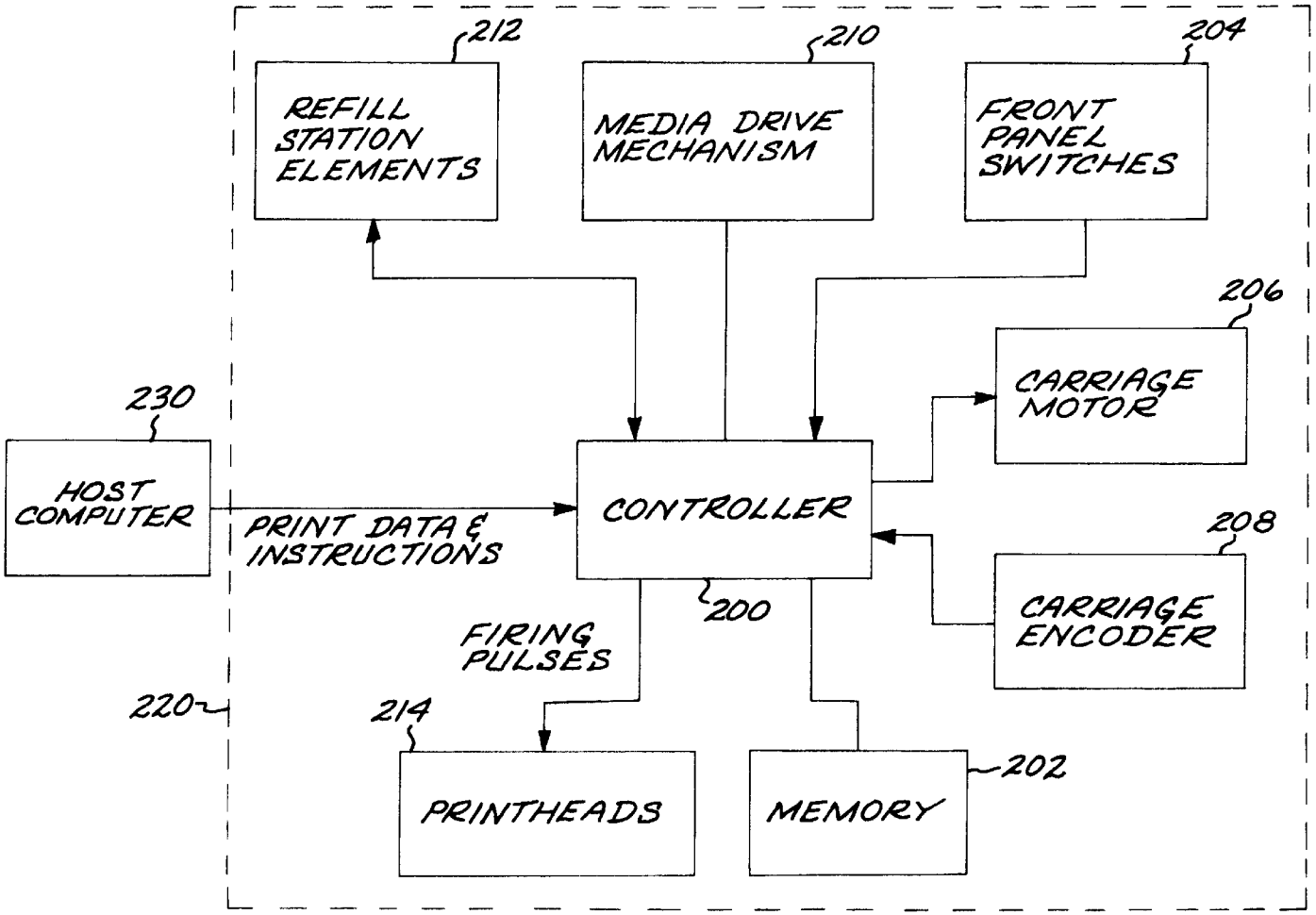
FIG. 4 is a simplified block diagram of the printer control system.

FIG. 4 is a simplified block diagram of the control system for the printer 50. Here, elements which comprise the printer 50 indicated by enclosure within phantom line 220. These elements include the controller 200, which can comprise, e.g., a microcomputer executing program instructions, or an ASIC with firmware defining the functions to be performed by the controller. The controller is programmed to receive data signals from various sensor elements, and to issue commands to various controllable elements. For example, the controller receives carriage position signals from the carriage encoder 208, and issues drive commands to the carriage motor 206 to scan the carriage along the scan axis and to position the carriage at desired positions, e.g. at the refill station. The controller 200 also controls the various elements 212 of the refill station, including the platform motor to raise the platform supporting the off-carriage ink reservoirs, and the valve arm motor to move the valves into engagement with the printheads when the carriage is positioned for refill. In addition, the controller issues drive commands to the media drive mechanism 210 to advance the print medium along the media path for printing. Thus, the controller 200 positions the medium for proper position during printing, and incrementally advances the medium during printing to print successive swaths. The controller also issues firing pulses to the nozzles of the printheads (shown generally as printheads 214 in FIG. 4). A memory 202 is provided as well for storage of various data including print swath data.

The system 50 receives print data instructions from an external source or writing system, shown in FIG. 4 as a host computer 230. Typically, the print data instructions can define a series of swaths forming a given plot, and usually do not instruct the controller prior to end of receipt of the full plot data instructions as the content of the plot. Commands are also entered by the user through front panel switches 204, e.g. via menu selection, to provide indications of the print media type and other variables.

Figure 5A:
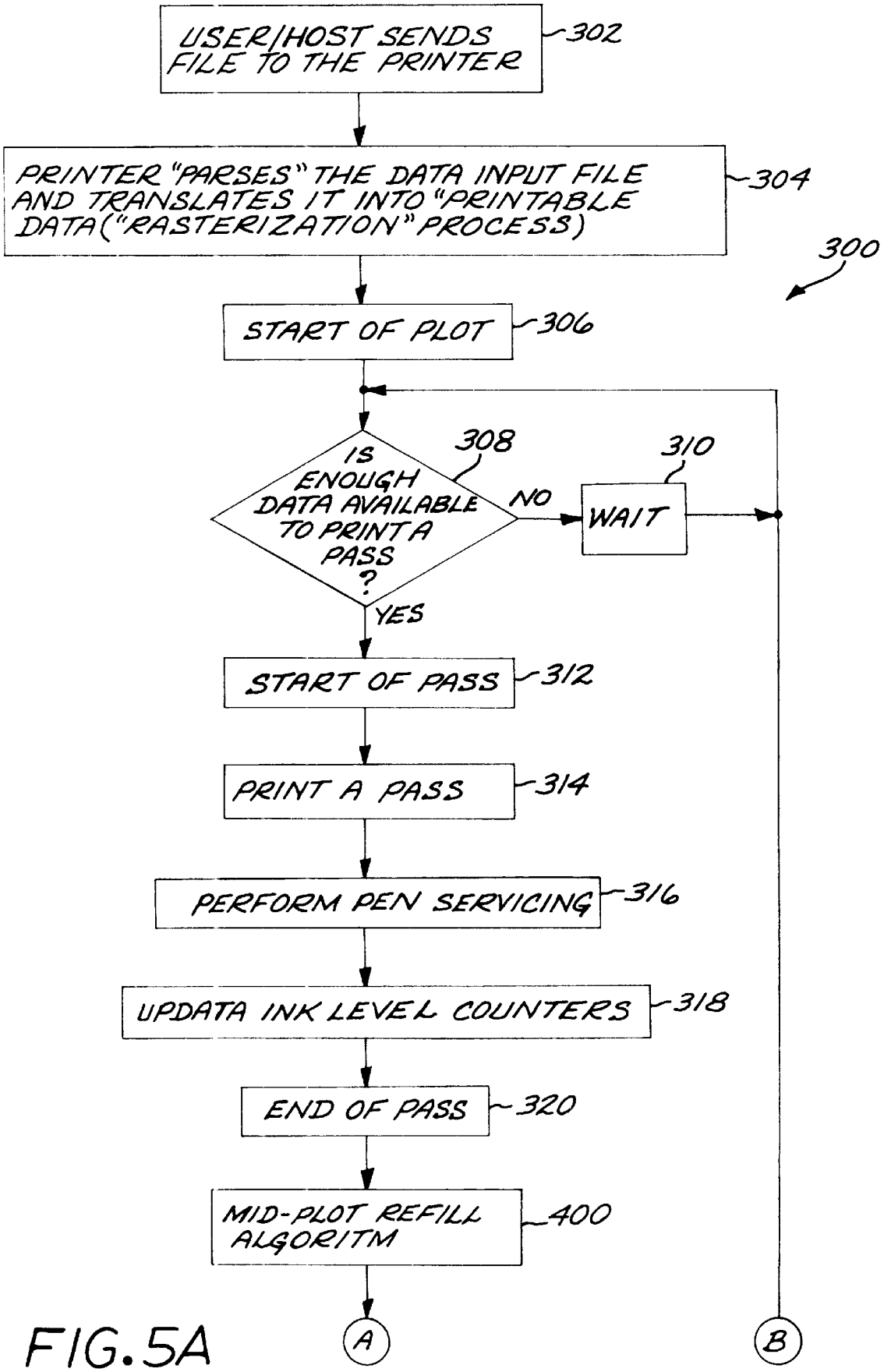
FIG. 5 is a simplified flow diagram of the printing mode of the system.
Figure 5B:
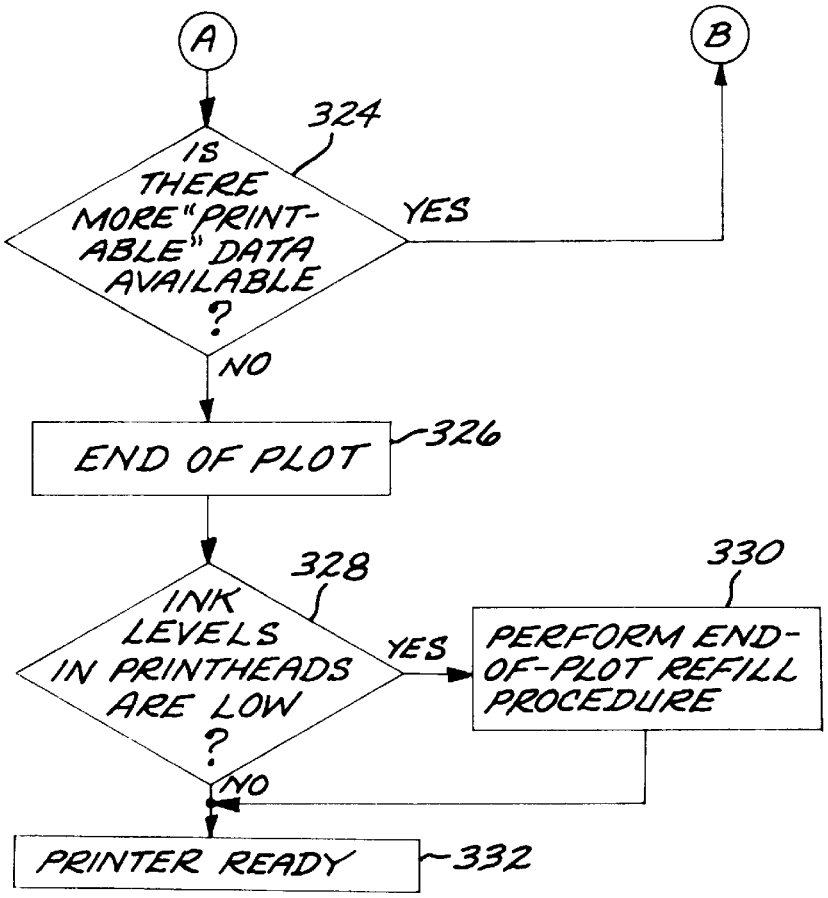

FIG. 5 shows a generalized top level flow diagram for the printer system operation in a normal printing mode. This generalized process 300 commences at 302 with receipt of a print file from the user/host, e.g. the host computer 230 (FIG. 4). At 304, the printer system 50 parses the data in the input file and translates it into printable data, i.e. a rasterization process. The plot is started at 306. Once enough data is available to print a pass (steps 308, 310) , the pass is started at 312, and the pass is printed (314). Once the pass is printed, a pen servicing is performed (316) if needed, and the ink level counters which keep track of the ink level in each printhead are updated (318). The end of the pass has now been reached (320).

At this point in the processing of this exemplary embodiment, the mid-plot refill algorithm 400 (shown in more detail in FIG. 7) in accordance with aspects of this invention is called, and a mid-plot refill procedure may be performed if recommended by the algorithm.

Upon return from the refill algorithm 400, at 324, the process determines whether more printable data is available for the plot, and if so, operation returns to step 308. If there is no more printable data, the end of plot has been reached (326). If the ink level in a printhead is low, as determined at step 328, an end-of-plot refill procedure is performed (step 330). The printer is now ready for another plot (332).

An aspect of the invention is a technique to decide when to start a refill process in the printer, i.e. to "trigger" a refill, when such a refill has to be performed while printing. Due to the fact that the on-carriage printheads hold a limited amount of ink, a refill is expected to occur during printing when any of the print-heads has reached an "out-of-ink" condition (Minimum Usable Ink After Refill level, or "MUIAR" level); printing after reaching the MUIAR level can damage the printhead. An objective of this aspect of the invention is to find the optimum place in the image being printed to perform the refill task, thus minimizing the Refill While Printing Artifact (RWPA).

Investigations about the RWPA have shown that an improvement might be achieved by refilling in places in the image being printed where the ink density is "low" (or where there is no ink at all). The artifact seems to be more visible with high densities of black and less visible with yellow ink (for the same amount of dropped ink). It is expected that prints benefiting from this algorithm will be those with "light" ink density areas alternated with darker ones in the X-axis, i.e. the media drive axis.

The refill trigger can be designed in a "hard" manner: if any of the cartridges reaches the "out-of-ink" condition (MUIAR level), then a refill is performed immediately to avoid damaging the printhead. For printheads in one exemplary embodiment, the below behavior has been observed:

For every media except backlit, the printing of an E-size plot is assured if the ink density is not more than 100%.

With backlit media (200% ink density) a midplot refill is expected in an E-size plot.

With any media a midplot refill on an E-size plot may occur if the ink density is over 80–90%.

Therefore, for some applications and plot sizes, a hard refill trigger can be employed in some situations. In such situations, it may be preferable to deal with the risk of being out-of-ink during a plot and provoking a hard refill than to use a "smart" refill trigger. Such a decision will typically involve the consideration of the amount of time needed to complete the plot, since the more refills, the longer the overall time needed to complete the plot. In a particular embodiment in accordance with the invention, an adaptive or 'smart' refill algorithm will not be applied for plots not larger than a given size, say E-size (in practice, with a printed length less than 44"). For this example, if the printed width is less than 885 mm (that is, a 36" roll width minus margins: 36×25.4−2×15 mm) and the printed length is less than 44" (ANSI-E 'long' dimension) then the 'smart' refill algorithm will be disabled. Otherwise (roll width larger than 36"), if the printed length is less than 34" (ANSI-E 'short' dimension) then any 'smart' refill algorithm will also be disabled.

Alternatively, for some applications and cartridges, an adaptive ("smart") refill algorithm will be enabled in accordance with the invention. The adaptive refill algorithm starts to look for an optimum place where to perform the refill task when a lower threshold of the remaining printhead ink level is reached. The algorithm does not immediately (upon starting a plot) begin to look for an optimum place to refill, but rather waits until some ink has been spent in the current plot before starting to compute the two criteria described below. However, the algorithm does immediately upon commencement of printing compute parameters such as the history of the ink densities of the past passes, the maximum density in a pass, and the like. This lower threshold should be chosed depending on the selected media and print quality, and it can be set or modified by a system user. Exemplary values for the threshold are:

100% of the ratio of the amount of ink spent to MUIAR, for 'fast' modes or where it is not necessary to take care about where the refill will be done. 100% of the ratio represents a 'hard' trigger for the refill.

75% of the ratio, recommended for plots not bigger than E-size.

<75% of the ratio, for 'best' modes when it is preferred to perform several refills during the printing, and the best place to perform the refill is to be found in accordance with the invention.

<30% of the ratio, according to the same criteria as the preceding value, but not recommended if the plot contains several blank swaths.

Once this lower threshold has been passed, several aspects are taken into account to find the best place to perform the refill (after every pass):

If a blank swath is found, then the refill is performed immediately. The information data for every swath is typically known before printing it. It would be very complex and time consuming to process this data in order to calculate the amount of ink to be spent during the swath printing. Yet, there are typically internal mechanisms within the printer controller to allow the controller to know if it is not needed to print a single dot during the next swath. Immediate refill at a blank swath has no image quality impact (no RWPA at all), but can delay the end of prints whose length would not need the refill on them.

If the length of the plot is known (as in PostScript or in HPGL2 languages), an estimate of the ink needed to print the rest of the plot can be stated. If the remaining ink is more than the 125% of the ink needed to end the print, then, in an exemplary embodiment, no refill is performed. Theoretically this has no image quality impact. That is, given the following parameter values:

inkSpent: maximum amount of ink spent among the four print cartridges.

printedHeight: printed length of the plot.

plotHeight: total length of the plot.

Then, if inkSpent*(plotHeight-printedHeight)*1.25>(MUIAR-inkSpent)*printedHeight, then no adaptive refill-while-printing (RWP) is undertaken. It is noted that typically there is no ink level sensor in the printhead reservoir, although this could be implemented. By keeping track of the ink expended, e.g. by counting the drops ejected from the respective printheads, and making assumptions as to the amount of ink in a replenished reservoir, the actual amount of ink remaining in the reservoirs can be estimated.

If the length of the plot is unknown or the estimation of the ink needed to finish the plot is not enough, or if the remaining ink does not exceed 125% of the ink needed to end the plot, a RWP will be performed. Then the ink density of the plot is taken into account in the following manner:

A refill has less impact on "low" ink density areas. The best place to do the refill is where a minimum in ink density is found. In general, the plot contents are unknown (or its effect on ink consumption are complex and time consuming to calculate); only the past information is known and can be used to detect local minima in the ink density.

The best way to know if the printer is printing a "light" pass or a "dark" pass would be to compare the ink dropped during the pass with the maximum amount of ink that could be dropped in a pass. This information is typically difficult to obtain. An "approximation" is used here. The darkest pass printed during the whole history of the current print is used as the maximum printable pass. This is not very accurate for very clear prints, i.e. prints with relatively few dots, with low optical density, but such prints have less concern about the RWPA. The spent ink during a pass is weighted depending on its type (color) , according to the below weights in an exemplary embodiment:

Cyan: 6 Yellow: 5

Magenta: 7 Black: 10

A first criterion for the absolute ink density, the AID criterion, of the pass is:

$$10*(1-[\text{current-pass ink-density}]/[\text{maximum ink-density}])$$

Thus, the ink density for the current pass is given by (InkDensity[t=0])=SUM {w[p]xInkSpent[p]}/SUM{w[p]}, where w[p] is the weight assigned to pen [p]. The maximum ink density is given by MaxInkDensity=MAX{InkDensity [StartOfPlot<t<0]}. The higher the AID criterion is, the stronger a refill is recommended, from the ink-density point of view.

In order to find the best place to do the refill it is also useful to know the "evolution" or history of the plot. If the plot is progressively lighter as printing proceeds, it can be expected to reach a local minimum later. In this case, the right strategy would be to wait for the local minimum and then do the refill. If the plot is progressively dark, then the refill is not recommended there (unless very close to MUIAR threshold).

As, in general, the contents of the drawing are not known in advance, the transitions from lighter to darker zones and vice versa are detected, in accordance with an aspect of the invention, by studying the "history" of the ink spent during some passes before the current one. In general, a swath is printed in several passes, where a pass is any of the movements of the carriage while printing on the medium. The length of the history in an exemplary embodiment is chosen as twenty passes. This example represents different "real" pass-history lengths as different print modes have different passes. Twenty passes can be quite lengthy when the passes are very long; however in such cases the print quality selected by the user is low, since more passes implies greater print quality. The fourteen "oldest" passes are considered as "past" and the remaining six passes are considered as "future". In this way, the decision as to whether the printing is at a local ink density minimum is taken as if the printing were six passes before from the point at which printing is now occurring. If there is more than one transition from a light to a dark area (or vice versa) in less than six passes (i.e. sharp ink density changes), those transitions will be hard to detect.

With the "past" and "future" histories, a "slope" is calculated for both of them and then compared to get a second criterion, the "LID" criteria. This is obtained in the following manner. Assume that History[20] is a vector of 20 elements, which are the ink density values obtained for the last 20 passes. Now, History[1] is the ink density for the current pass, History[2] is the ink density value for the previous pass (pass-1), History[3] is the ink density value for pass-2, and so on, with History[20] the ink density value for pass-19. A straight line fitted to the six points History[1] , History[2] . . . History[6] by a mean-squared method has a slope fs. A straight line fitted to the "oldest" 14 points, History[7] . . . History[19] has a slope ps.

The LID criterion is obtained by a combination of the two slopes according to the following table:

| 2nd Criterion | "past" slope | "future" slope | Description |
|---|---|---|---|
| 9 | ps < −1% | −1% < fs < 1% | Local density minimum |
| 8 | ps < −1% | fs > 1% | Sharp local ink-density minimum |
| 7 | ps < −1% | fs < −1% | Plot progressively light |
| 6 | −1% < ps < 1% | fs < −1% | Transition to a progressively light zone |
| 5 | −1% < ps < 1% | −1% < fs < 1% | No transition detected; area fill |
| 4 | −1% < ps < 1% | fs > 1% | Transition to a progressively dark zone |
| 3 | ps > 1% | fs < −1% | Sharp local ink-density maximum |
| 2 | ps > 1% | −1% < fs < 1% | Local ink-density maximum |
| 1 | ps > 1% | fs > 1% | Plot progressively dark |

The LID criterion in this exemplary embodiment has integer values only in the range from 1 to 9. The higher the LID criterion, the stronger is the recommendation to perform a refill from the local ink density point of view.

An overall ink-density criterion, the "OID" criterion, is finally chosen by multiplying the two criteria stated above. This type of operation is preferred to a weighted average because it emphasizes extreme behaviors (like low absolute ink density and local ink density minimum). Of course, alternate criterion can be employed for some application, including the weighted average.

By "adaptive triggers" is meant that, once the lower threshold has been passed, the above two criteria are progressively relaxed, according to the remaining ink in the cartridges. That is, when that threshold has just been passed (75% of the MUIAR), a refill will be performed only at a "local minimum" with a very "light" ink density; if the ink dropped is more than the 90% of the MUIAR a place not so clear (i.e. a low ink density place) is enough to decide to do the refill. In any case, a refill is performed when the ink spent surpasses the MUIAR.

Figure 6:
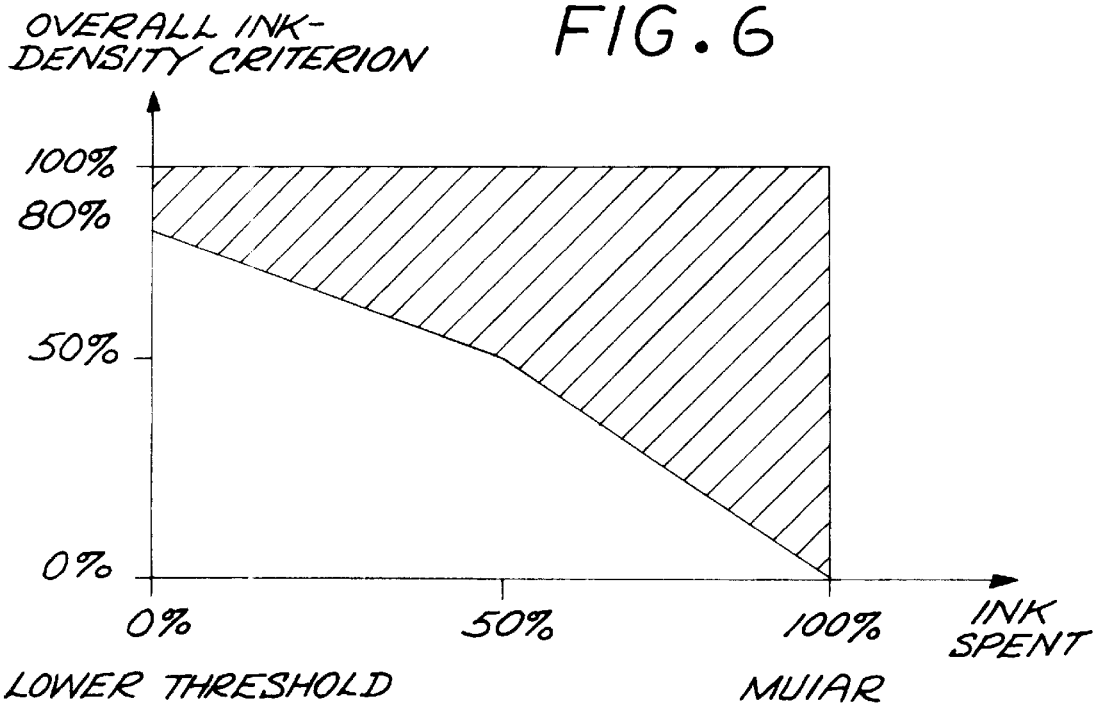
FIG. 6 is a graph plotting an overall ink-density criterion calculated in accordance with the invention as a function of the Minimum Usable Ink After Refill (MUIAR) predetermined level for a printing system.

The adaptive trigger to perform the refill considers both the overall ink-density criterion and the remaining ink in the cartridges, according to the graph shown in FIG. 6. When the ink remaining is not too low yet, the ink-density criterion is quite high; if the out-of-ink status is nearly to be reached, the ink-density criterion is severely decreased.

Figure 7:
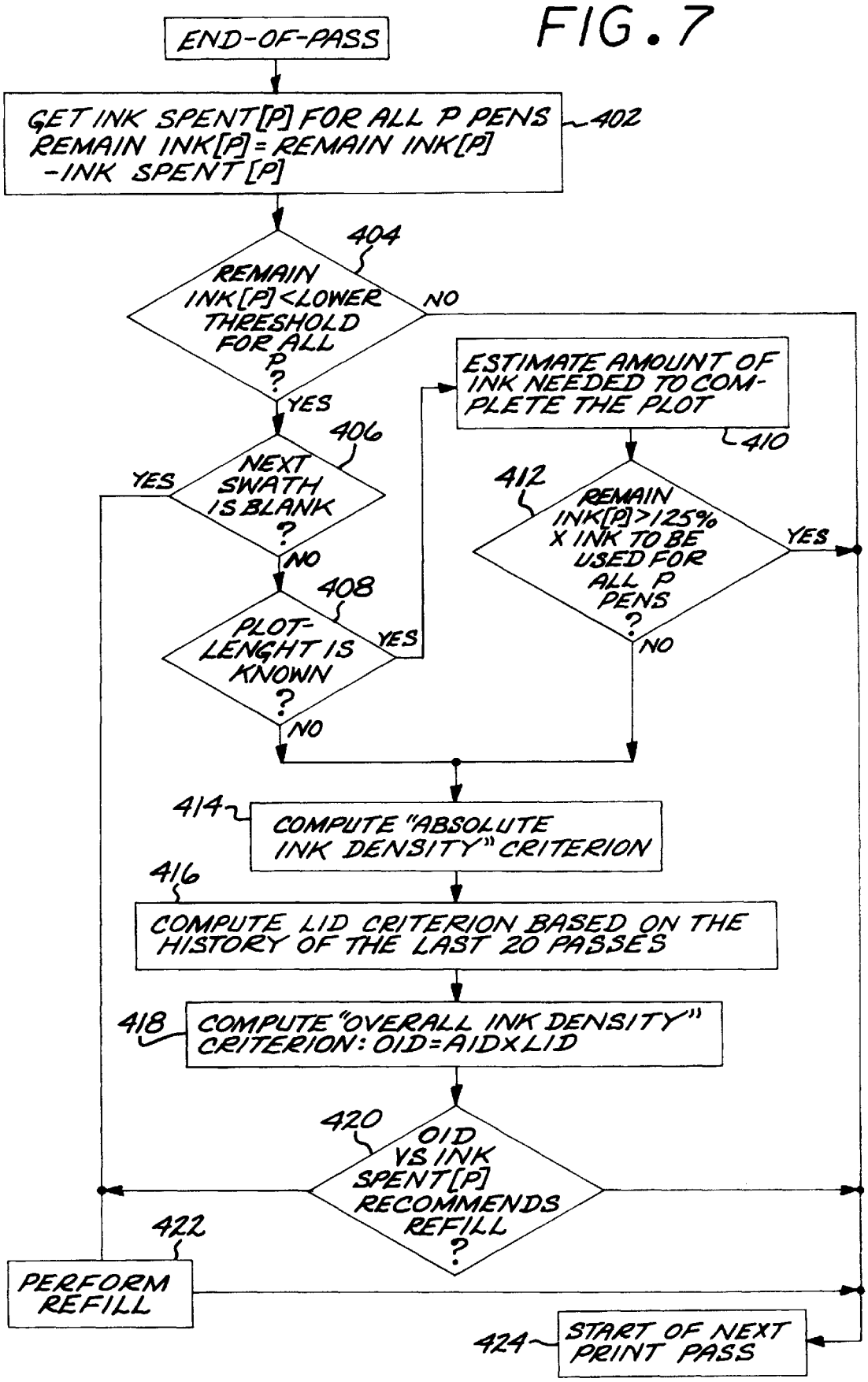
FIG. 7 is a simplified flow diagram illustrating a process for adaptively triggering pen refill in mid-plot.

FIG. 7 illustrates in flow diagram form an exemplary adaptive refill trigger algorithm in accordance with the invention. The algorithm is performed at the end of each pass of the carriage during printing. Thus, at the end-of-pass, the algorithm retrieves from the pen manager the value for the parameter inkSpent[p] for all print cartridges, and calculates the parameter RemainInk[p] as the previously calculated value for RemainInk[p] minus the retrieved value for inkSpent[p] (step 402) . If at 404 this calculated parameter value for RemainInk[p] is not less than the lower threshold for all pens, operation proceeds to step 424 to start the next print pass processing. If the remaining ink parameter is less than the lower threshold, operation proceeds to step 406.

If at 406 the next swath is a blank swath, operation immediately proceeds to step 422 to perform a refill. If at 406, on the other hand, the next swath is not a blank swath, and if the length of the plot, parameter plotLength, is known (step 408) , operation proceeds to step 410 to estimate the amount of ink needed for completion of the plot (InkToBeUsed). In this exemplary embodiment, InkToBeUsed=MAX {inkSpent[p]}×(plotLength−printedHeight)/−printedHeight. If the remaining ink exceeds 125% of the estimated needed amount for all pens, the algorithm determines that no refill is needed, and operation proceeds to step 424 to commence the next start-of-print pass.

If at 408 the plotLength parameter is not known, or at step 412 if the remaining ink does not exceed 125% of the estimated required amount, operation proceeds to step 414. Here the absolute ink density (AID) criterion is computed.

In this embodiment, the AID criterion is calculated in the following manner, where w[p] represents the weight assigned to the particular pen [p] according to the color weight described above.

$$\text{InkDensity}[t=0]=\text{SUM}\{w[p]\times\text{inkSpent}[p]\}/\text{SUM}\{w[p]\}$$

$$\text{MaxInkDensity}=\text{MAX}\{\text{InkDensity}[\text{StartOfPlot}<t<0]\}$$

$$\text{AID}=10(1-\text{InkDensity}[0]/\text{MaxInkDensity})$$

Next at 414 the local ink density (LID) criterion is computed based on the last 20 passes. At 418, the overall ink (OID) criterion is computed, using the absolute (AID) and local ink density (LID) criteria. The overall ink density criterion versus the inkspent[p] parameter value is used at step 420 to determine whether to refill (step 422) before proceeding to the start of the next print pass processing (step 424).

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method of adaptively triggering a refill operation in an on-carriage printhead having an associated printhead reservoir in a printer having a movable carriage mounting the printhead, the printer including an off-carriage ink supply available for intermittent connection to the printhead reservoir for the refill operation, the printer including a system for tracking the amount of ink remaining in the printhead reservoir the method comprising the following steps:

commencing a printing operation for a plot;

determining whether a refill operation needs to be performed prior to completion of the plot;

determining a location in the plot of low ink density after commencement of said printing operation;

interrupting the printing to perform a refill operation for the printhead reservoir at said low ink density location to reduce printing artifacts; and resuming the printing of the plot.

2. The method of claim 1 wherein said step of determining the location in the plot of low ink density includes predicting said location without a prior knowledge of the print density for given swaths.

3. The method of claim 2 wherein said step of determining the location in the plot of low ink density includes predicting the location in dependence on a past history of the plot.

4. The method of claim 1 wherein said step of determining the location in the plot of low ink density includes determining said location in dependence on a local ink density criterion and an absolute ink density criterion.

5. The method of claim 4 further comprising the steps of:

calculating said local ink density criterion; and calculating said absolute ink density criterion.

6. The method of claim 5 wherein said step of calculating said local ink density criterion includes determining said local ink density criterion in dependence on ink densities of a plurality of recently printed passes of said carriage.

7. The method of claim 5 wherein said step of calculating said absolute ink density criterion includes determining said criterion in dependence on the darkest of all printed passes of said carriage during said printing of said plot.

8. The method of claim 5 wherein the step of calculating said local ink density and the step of calculating said absolute ink density are commenced subsequent to the start of printing of said plot, and only after a threshold related to an amount of ink spent by the printhead has been exceeded.

9. The method of claim 8 wherein said threshold is selected in dependence on a print medium type and a print quality.

10. The method of claim 1 wherein said step of determining whether a refill operation needs to be performed includes forming an estimate of an amount of ink needed to complete the plot if the plot length is known, determining whether the remaining amount of ink in said printhead reservoir exceeds said estimated amount by a margin, and determining that a refill operation needs to be performed prior to completion of the plot if said remaining amount of ink does not exceed said estimated amount by said margin.

11. The method of claim 1 further comprising, following the refill determining step, the steps of determining whether the next swath to be printed is a blank swath, and if so, interrupting said printing operation to perform a blank swath refill operation.

12. In a full color printer having a plurality of on-carriage printheads for applying ink of different colors to a print medium during printing operations, a method of adaptively triggering a refill operation in said on-carriage printheads, each printhead having an associated printhead reservoir, the printer having a movable carriage mounting the printheads, the printer including a plurality of off-carriage ink supplies of different colors available for intermittent connection to a corresponding printhead reservoir for the refill operation, the method comprising the following steps:

commencing a printing operation for a color plot;

determining whether a refill operation needs to be performed prior to completion of the plot for any of the printheads;

determining a location in the plot of low ink density after commencement of said printing operation;

interrupting the printing to perform a refill operation for the printhead reservoirs at said low ink density location to reduce printing artifacts; and resuming the printing of the plot.

13. The method of claim 12 wherein said step of determining the location in the plot of low ink density includes predicting said location without a prior knowledge of the print density for given swaths.

14. The method of claim 13 wherein said step of determining the location in the plot of low ink density includes predicting the location in dependence on a past history of the plot.

15. The method of claim 12 wherein said step of determining the location in the plot of low ink density includes determining said location in dependence on a local ink density criterion and an absolute ink density criterion.

16. The method of claim 15 further comprising the steps of:

calculating said local ink density criterion; and calculating said absolute ink density criterion.

17. The method of claim 16 wherein said step of calculating said local ink density criterion includes determining said local ink density criterion in dependence on ink densities of a plurality of recently printed passes of said carriage.

18. The method of claim 16 wherein said step of calculating said absolute ink density criterion includes determining said criterion in dependence on the darkest of all printed passes of said carriage during said printing of said plot.

19. The method of claim 16 wherein said plurality of printheads includes a cyan printhead, a yellow printhead, a magenta printhead and a black printhead, and wherein said step of calculating said absolute ink density criterion includes weighting the amount of ink spent for each printhead in a given pass by color.

20. The method of claim 19 wherein said step of calculating said absolute ink density criterion for said given pass includes:

weighting the amount of ink spent for said given pass by the black printhead by a first weight value;

weighting the amount of ink spent for said given pass by the magenta printhead by a second weight value;

weighting the amount of ink spent for said given pass by the cyan printhead by a third weight value;

weighting the amount of ink spent for said given pass by the yellow printhead by a fourth weight value, wherein said first weight is larger than said second weight, said second weight is larger than said third weight, and said third weight is larger than said fourth weight; and summing said weighted amounts.

21. In a color printer having a plurality of on-carriage printheads for applying ink of different colors to a print medium during printing operations, a method of adaptively triggering a refill operation in said on-carriage printheads, each printhead having an associated printhead reservoir, the printer having a movable carriage mounting the printheads, the carriage being moved through a succession of passes transversely to the print medium with one or more passes forming a printed swath, the printer including a plurality of off-carriage ink supplies of different colors available for intermittent connection to a corresponding printhead reservoir for the refill operation, the method comprising the following steps:

commencing a printing operation for a color plot;

determining whether a refill operation needs to be performed prior to completion of the plot for any of the printheads;

if the next swath to be printed is a blank swath, interrupting the printing operation between passes to perform a blank swath refill operation;

if the next swath to be printed is not a blank swath, determining a location in the plot of low ink density;

continuing said printing until said low ink density location has been reached, and interrupting the printing between passes to perform a low density location refill operation for the printhead reservoirs to reduce printing artifacts; and resuming the printing of the plot.

* * * * *